US010935246B2

(12) United States Patent
Tran et al.

(10) Patent No.: US 10,935,246 B2
(45) Date of Patent: Mar. 2, 2021

(54) MASS-ATTENUATED THERMOSENSITIVE DAMPER FOR SEALED DIRECT-VENT GAS FIREPLACE

(71) Applicant: Miles Industries Ltd., North Vancouver (CA)

(72) Inventors: Calvin Tran, North Vancouver (CA); Ivan Scekic, North Vancouver (CA); Martin Miles, North Vancouver (CA)

(73) Assignee: Miles Industries Ltd., North Vancouver (CA)

( * ) Notice: Subject to any disclaimer, the term of this patent is extended or adjusted under 35 U.S.C. 154(b) by 118 days.

(21) Appl. No.: 16/010,381

(22) Filed: Jun. 15, 2018

(65) Prior Publication Data

US 2019/0017708 A1 Jan. 17, 2019

(30) Foreign Application Priority Data

Jul. 17, 2017 (CA) ..... CA 2973564

(51) Int. Cl.
*F24B 1/189* (2006.01)
*F24B 1/187* (2006.01)

(52) U.S. Cl.
CPC ..... *F24B 1/1895* (2013.01); *F24B 1/187* (2013.01)

(58) Field of Classification Search
CPC ..... F24B 1/1895; F24B 1/187
USPC ..... 126/504
See application file for complete search history.

(56) References Cited

U.S. PATENT DOCUMENTS 3,842,382 A * 10/1974 Bell ..... H01H 5/20 337/107
4,136,323 A * 1/1979 D'Entremont ..... H01H 61/02 337/102
4,633,210 A * 12/1986 Mallonen ..... H01H 71/162 337/101
6,308,701 B1 * 10/2001 Jaasma ..... F23K 3/06 110/190
2012/0090596 A1 * 4/2012 Miles ..... F23L 13/00 126/502

* cited by examiner

*Primary Examiner* — Steve B McAllister
*Assistant Examiner* — Aaron H Heyamoto
(74) *Attorney, Agent, or Firm* — Mahamedi IP Law LLP

(57) ABSTRACT

A separate heat absorbing mass is secured in co-planar abutment with a bimetal strip controlling a fireplace damper to absorb heat from the flue gases. The mass transfers heat to the bimetal strip during the OFF cycle thereby delaying the opening of the damper and increasing the heat retention and efficiency of the fireplace.

7 Claims, 14 Drawing Sheets

Bimetal temperature and flue gas temperature with no steel block attached at 13,000 BTU/hr Bimetal temperature and flue gas temperature with steel blocks attached at 24,000 BTU/hr Bimetal temperature and flue gas temperature with steel blocks attached at 13,000 BTU/hr

MASS-ATTENUATED THERMOSENSITIVE DAMPER FOR SEALED DIRECT-VENT GAS FIREPLACE

FIELD OF THE INVENTION

This invention relates to improving the efficiency of sealed, direct vent gas fireplaces, including the efficiency of heat retention during the OFF cycle of a sealed, direct vent gas fireplace.

BACKGROUND OF THE INVENTION

U.S. patent application Ser. No. 12/906,757 discloses the use of a bimetal-actuated damper within the ducting of a sealed, direct vent gas fireplace, designed largely to avoid the problem of cold ignition of the fireplace. Where there are vertical runs of duct feeding into the fire box, cold stagnant air may need to heat up before being able to migrate upward out of the firebox. As a result, in some cases ignition of a pilot light cannot be maintained. The invention described in the '757 application provides a bimetal-actuated damper which is in a normally open position allowing for maximum airflow out of the firebox to accommodate cold starts. The bimetal actuator closes the damper under the influence of heat to maintain the operating efficiency of the fireplace when running hot, i.e. during the ON cycle.

It is also desirable for regulatory and other reasons to reduce heat losses into the venting system shortly after initiation of the OFF cycle (the shut off and cool down phase). Cyclic efficiency testing of the '757 invention revealed that although the problem of cold starts appears to be solved, the bimetal actuator tends to cool down and cause the damper to open fairly rapidly once the fireplace is turned off. Using a rectangular Ni/Fe/Mn bimetal strip having dimensions of 18 mm by 117 mm and a thickness of 1 mm, mounted in an exhaust duct at a steady state ON temperature of about 482° F., the bimetal was acting to open the damper within about 10 minutes of turning off the fireplace. As a result, the OFF cycle efficiency (i.e., the retention of heat in the appliance rather than allowing it to escape into the vent system) was low as compared to the target measure of 16 minutes used as a rule of thumb in cyclic efficiency testing standards.

Another issue that arose during testing was the location of the damper and of the bimetal actuator. While it was feasible to mount the actuator and damper assembly in the exhaust duct, it was found that the system suffered a loss of combustion during overfire testing (sustained, higher than normal, temperature). It was also cumbersome to accommodate the assembly in the exhaust duct.

The inventors therefore turned their mind to providing a bimetal-actuated damper in the vent system of a sealed direct vent gas fireplace which not only embodied the principle of the '747 invention but that also addresses the problem of heat loss during the OFF cycle.

It is therefore an object of this invention to provide an automatic, thermosensitive damping system that both enables cold starts in a sealed, direct-vent gas fireplace while also providing good OFF cycle efficiency.

It is a further object of the invention to provide an automatic damping system that is functional, practical to incorporate into the fireplace venting system and that does not significantly inhibit good combustion in overfire conditions.

These and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY OF THE INVENTION

According to one aspect of the invention, at least one separate heat absorbing block (referred to herein as a "thermal" mass or block) is secured in co-planar abutment with a bimetal strip controlling a normally open damper, i.e. a damper that is open at room temperature. The block absorbs and retains heat from the flue gases and continues to gradually dissipate its previously absorbed heat into the bimetal strip after the fireplace has been turned off. This has the result of decreasing the rate at which the bimetal strip cools down during the OFF cycle. As a result, the damper remains closed for a longer period of time than would be the case if the bimetal strip was acting alone under the influence of the cooling ambient gases in the duct.

The geometry and combined mass of the strip and the thermal block determine the rate of heat dissipation of the combination. Preferably, the bimetal strip and attached block have a combined surface area and rate of heat dissipation that induce a delay of at least several minutes in the opening of the damper after initiation of the OFF cycle of a fireplace from a steady state ON flue temperature of 500° F. to 600° F., as compared to use of the bimetal strip alone.

The preferred shape of the thermal mass is a rectangular block and its mass is at least five times the mass of the bimetal strip itself. The block is preferably attached to the bimetal strip so that the area of co-planar abutment of the block to the strip spans the width of the strip, along the majority of the length of the strip. A portion of the strip should remain sufficiently unconstrained to allow bending of the bimetal strip.

In another aspect of the invention, the bimetal strip and the thermal mass are located in an exhaust duct of the fireplace but actuate a damper located in the inlet duct. The inventors have found that operating the damper on the inlet side of the ducting while the bimetal is in the exhaust duct allows for better control of the air and combustion products throughput of the fireplace, is less cumbersome than installing a combined assembly in the same duct, offers combustion efficiency that is relatively unimpeded by the damping system, and adequately senses the temperature in the exhaust.

In a further aspect, the invention provides an enclosure connecting the bimetal coil and thermal mass to the damper, each in separate ducts.

In an aspect, the invention is a damper actuation system for use in actuating a normally open damper in a sealed, direct-vent gas fireplace. The system comprises a bimetal strip for actuating the damper and at least one heat absorbing block secured in co-planar abutment with the strip for attenuating changes in the temperature of the strip under the influence of gases in the duct, the block having a mass that is at least 5 times the mass of the strip.

In a more particular aspect, the block induces a delay in the opening of the damper. The delay is compared to a baseline when the temperature of the gases in an exhaust duct of the fireplace are over 480° F. and an OFF cycle is initiated. The induced delay is at least 5 minutes as compared to when no heat absorbing block is used under the same conditions.

The heat absorbing block may comprise at least one rectangular block that is attached to the bimetal strip so that the co-planar abutted portion spans the width of the bimetal strip along at least 50% of the length of the strip. In a more particular aspect, the block also has a width no greater than the width of the strip.

The strip and the block are preferably located in an exhaust duct of said fireplace.

In another aspect the invention consists of the use of any of the damper system features described above and in which the strip and the block are located in an exhaust duct and the damper is located in an inlet duct of the fireplace. The strip and the block may maintain average temperatures over 5 minute intervals at a longitudinal center of the strip, during an OFF cycle of initiated when the temperature of gases in the exhaust duct are at least 480° F., that are at least 25% higher than the average temperatures, over the same 5 minute intervals, of the exhaust gases during the OFF cycle when no heat absorbing block abuts the bimetal strip.

The foregoing may cover only some of the aspects of the invention. Other aspects of the invention may be appreciated by reference to the following description of at least one preferred mode for carrying out the invention in terms of one or more examples. The following mode(s) for carrying out the invention is not a definition of the invention itself, but is only an example that embodies the inventive features of the invention.

BRIEF DESCRIPTION OF THE DRAWINGS

At least one mode for carrying out the invention in terms of one or more examples will be described by reference to the drawings thereof in which.

DETAILED DESCRIPTION OF AT LEAST ONE MODE FOR CARRYING OUT THE INVENTION IN TERMS OF EXAMPLE(S) AND EMBODIMENT(S)

In this disclosure, the term "thermal mass" or "thermal block" will sometimes be used to refer to the separate mass/block that is attached to the bimetal strip for the purpose of attenuating the heat loss of the bimetal strip. The term "thermal mass" is intended to characterize the mass as having thermal properties that serve to absorb, retain and dissipate heat in accordance with the objects of the invention.

Figure 1A:
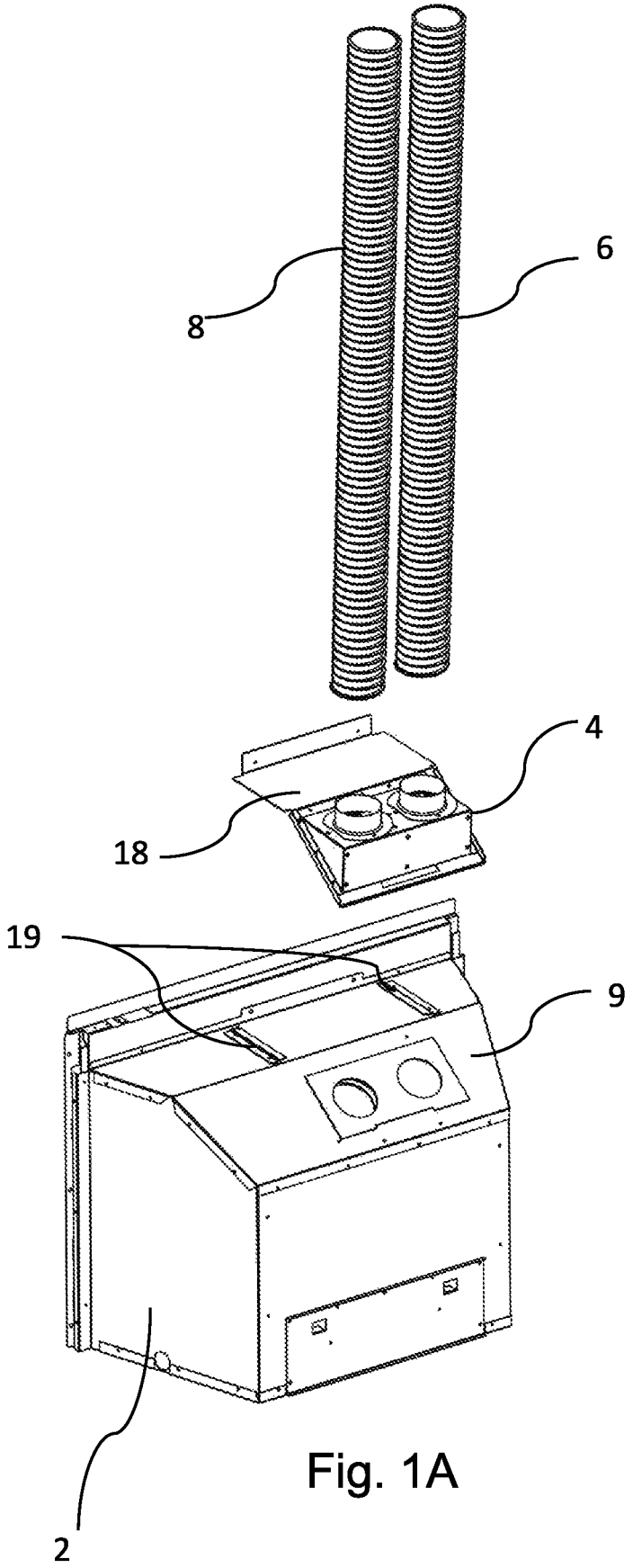
FIG. 1A is a rear side view of a gas fireplace unit and in exploded position a duct interface assembly according to the preferred embodiment and ducts.
Figure 1B:
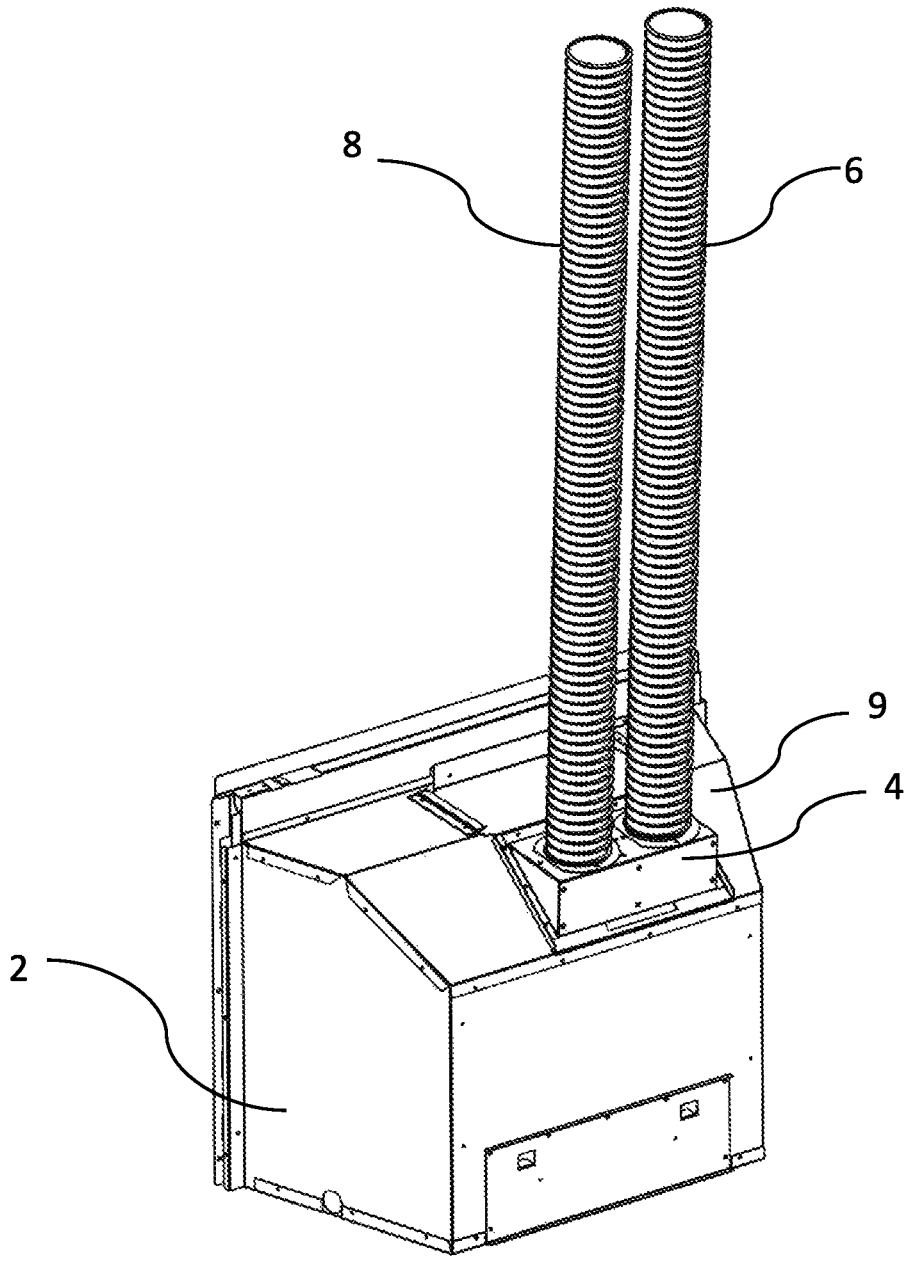
FIG. 1B is a rear side view of a gas fireplace unit with the duct interface assembly and ducts attached.

FIGS. 1A and 1B show a sealed, direct-vent gas fireplace 2 along with a duct interface assembly 4, an inlet duct 6 and an outlet duct 8. The inlet and outlet ducts are mounted vertically in the preferred set up making use of the present invention.

Figure 2A:
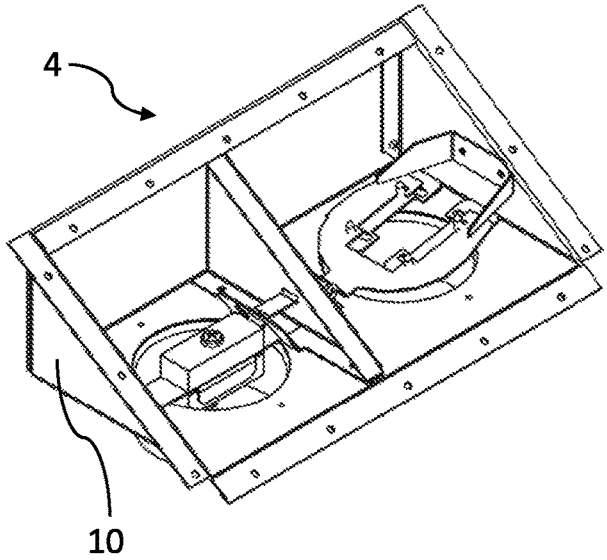
FIG. 2A is a bottom perspective view of a duct interface assembly according to the preferred embodiment.
Figure 2B:
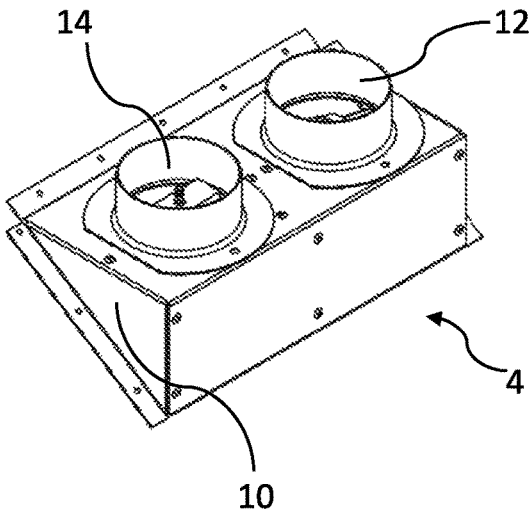
FIG. 2B is top perspective view of the duct interface assembly.
Figure 2C:
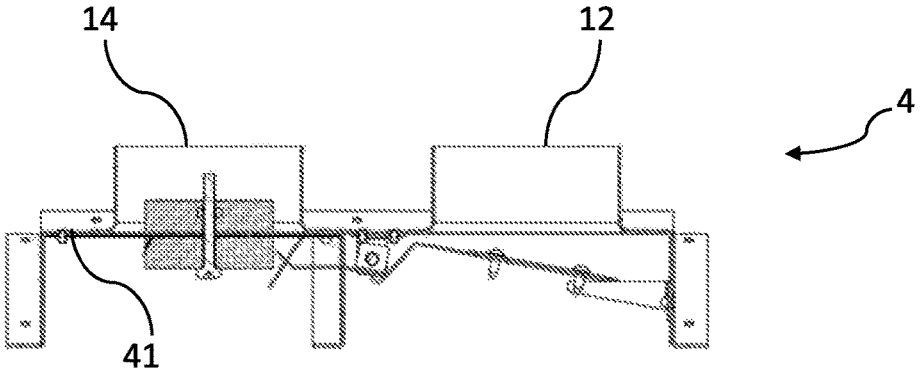
FIG. 2C is a vertical sectional view of the duct interface assembly.

FIGS. 2A-2C show different views of the duct interface assembly according to the preferred embodiment. In the preferred version of a gas fireplace, the duct assembly 4 is mounted on an angled rear panel 9 (see FIGS. 1A and 1B) of the gas fireplace.

The interface assembly 4 includes a casing 10, an inlet duct collar 12, an outlet duct collar 14 and a damper sub-assembly 16 (best seen in FIG. 3) that is mounted to straddle the inlet and outlet duct collars.

Figure 3:
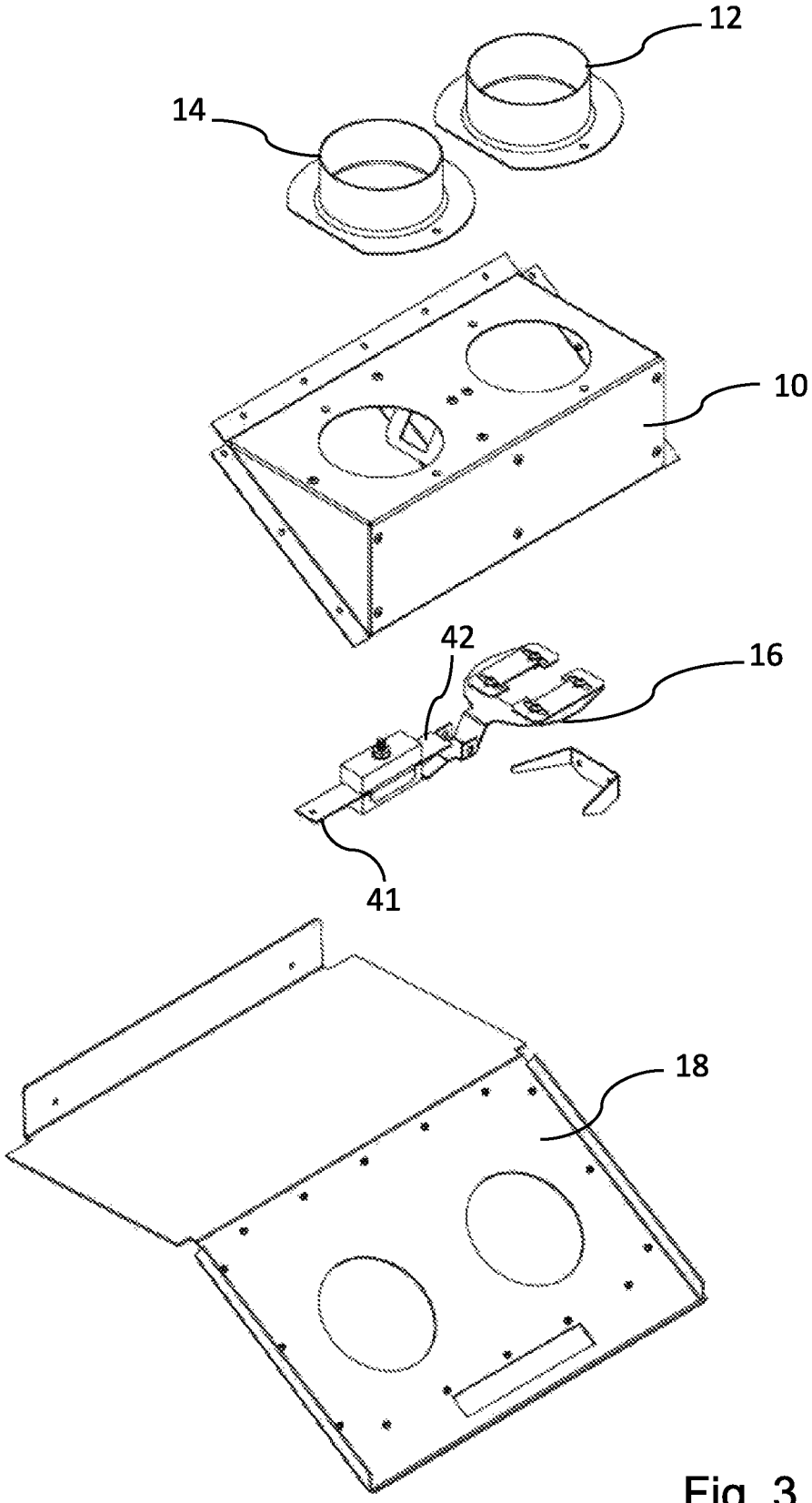
FIG. 3 is an exploded view of the duct interface assembly and a mounting plate portion of the fireplace.

FIG. 3 is an exploded view of the duct interface assembly 4 including a mounting plate 18 that slides into guides 19 on the fireplace.

Figure 4:
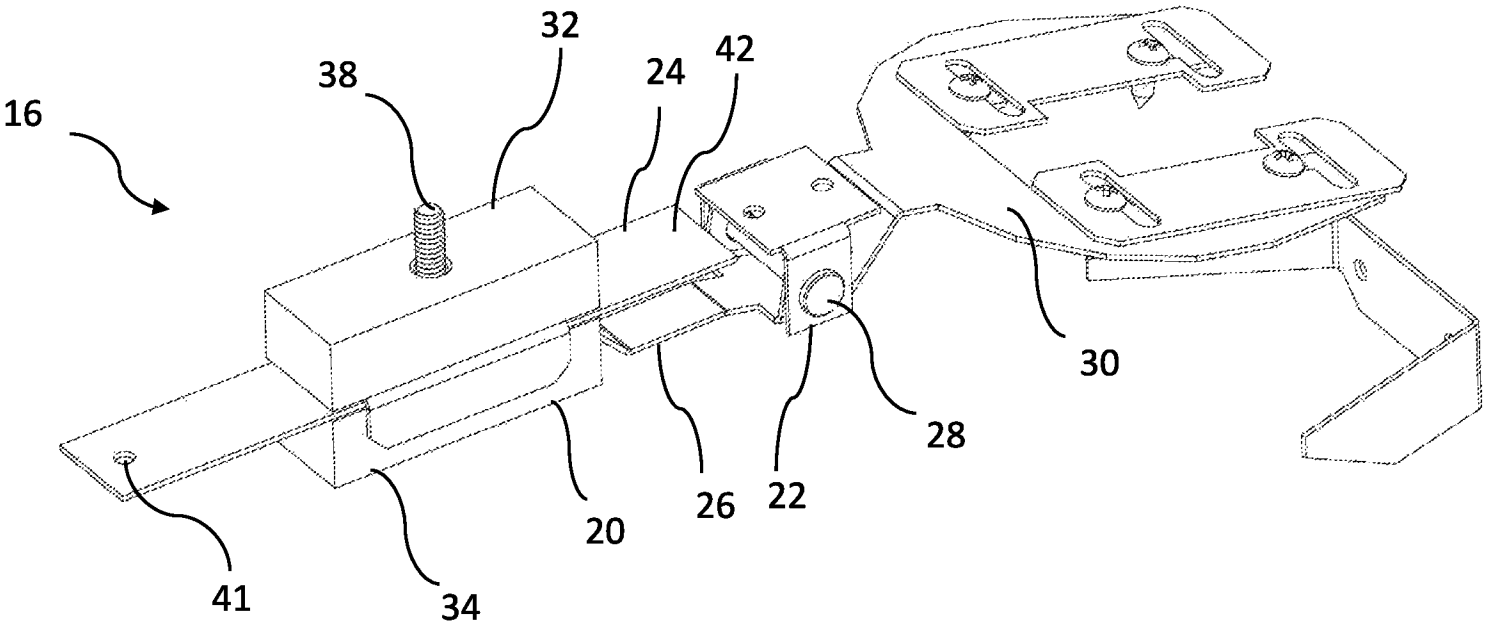
FIG. 4 is a perspective view of the damper sub-assembly according to the preferred embodiment.
Figure 5A:
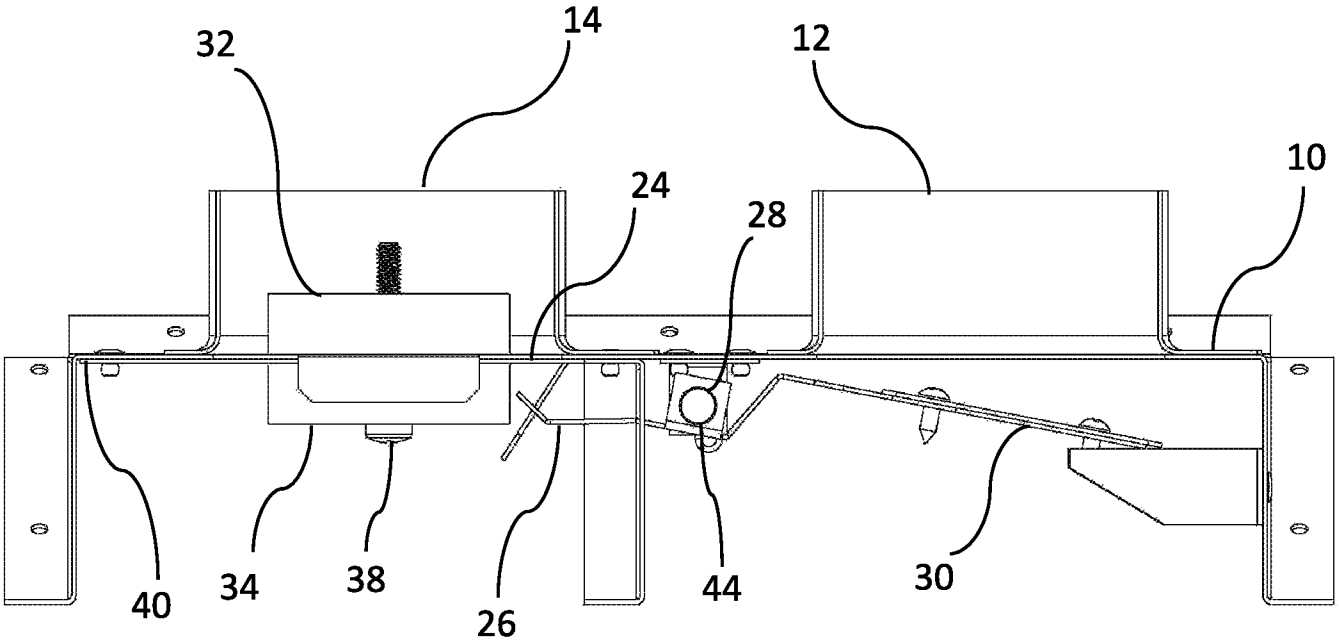
FIG. 5A is a side sectional view of the duct interface assembly, with the damper sub-assembly in its normally open position in relation to the inlet duct collar.
Figure 5B:
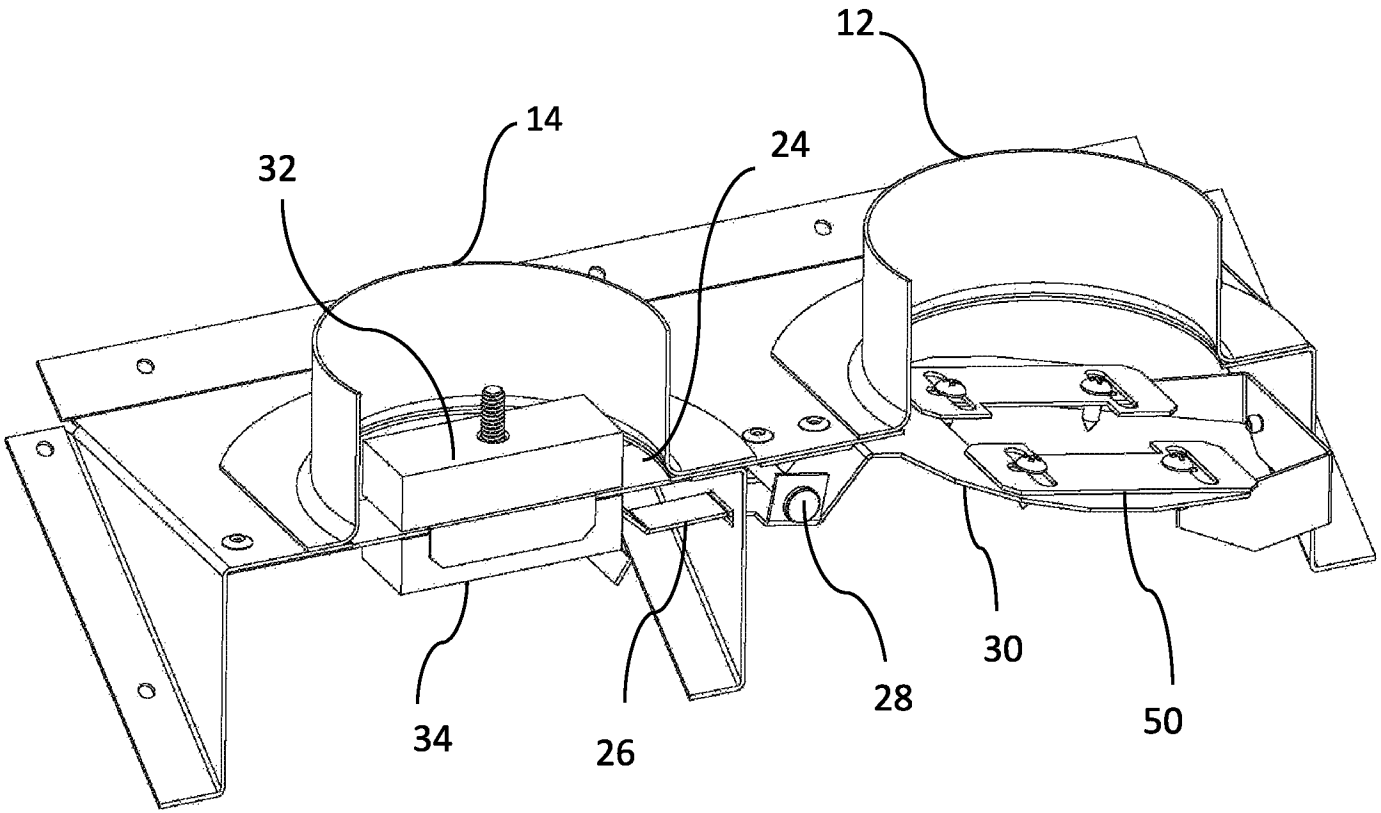
FIG. 5B is the same view as FIG. 5*a* but taken from a perspective angle.
Figure 6A:
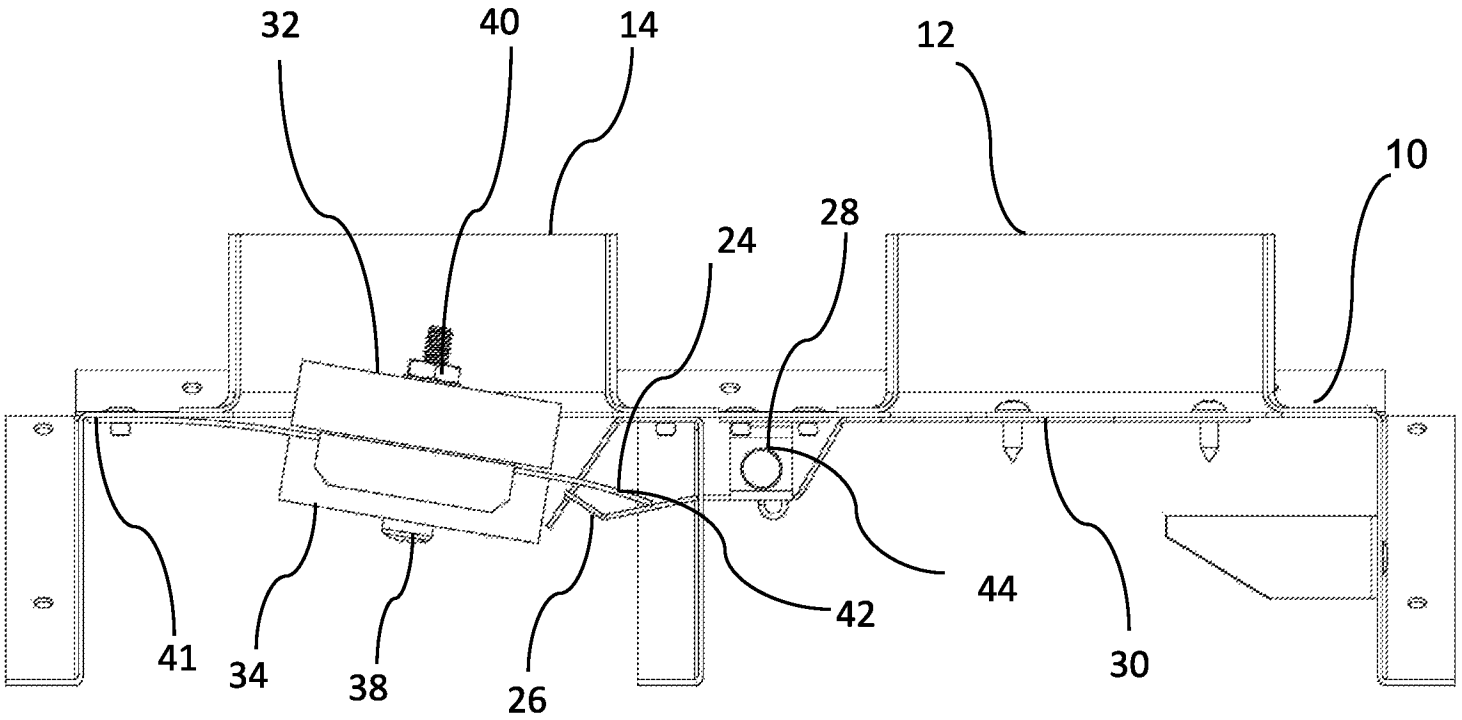
FIG. 6A is a side sectional view of the duct interface assembly, with the damper sub-assembly in the closed position in relation to the inlet duct collar.
Figure 6B:
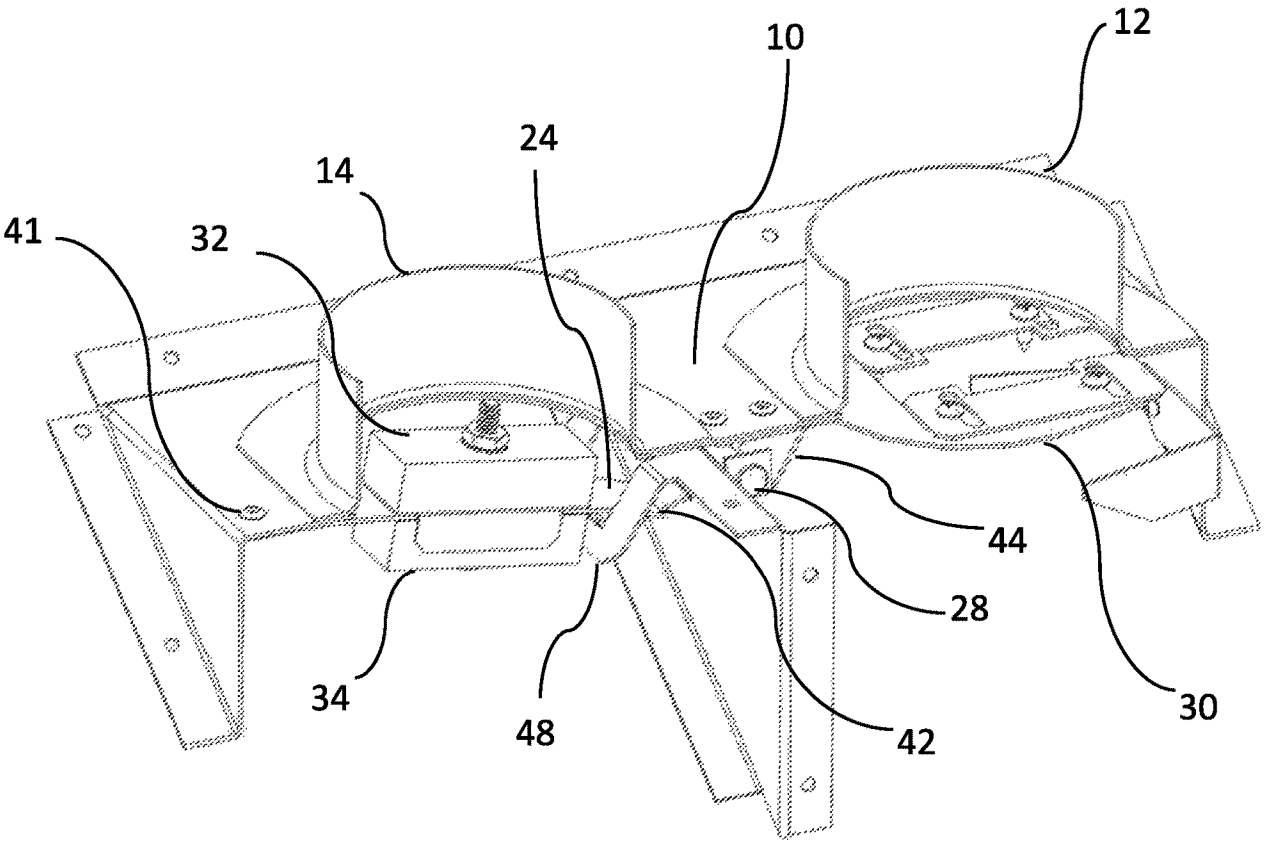
FIG. 6B is the same view as FIG. 6*a* but taken from a perspective angle.

Referring to FIG. 4, the damper sub-assembly 16 comprises two components: a bimetal and thermal mass block assembly 20 and a pivoted damper assembly 22. Referring to FIGS. 5A, 5B, 6A and 6B, the pivoted damper assembly 22 is actuated to pivot according to the displacement of the bimetal 24. When the bimetal and thermal mass block assembly 20 is cold and the bimetal strip 24 is in its room-temperature steady state (unbent) there is no contact between the bimetal strip 24 and the damper tongue 26 as shown in FIGS. 5A and 5B, leaving the damper assembly 22 in its normally open position with the damper 30 open in relation to the inlet duct collar 12. When the bimetal and thermal mass block assembly 20 is heated to its high temperature steady state as shown in FIGS. 6A and 6B, the bimetal strip 24 bends to contact the tongue 26 and urge it downward so as to pivot the damper assembly 22 about a hinge 28 thereby closing the damper 30 against the inlet duct collar 12.

According to the preferred embodiment, the thermosensitive bimetal strip consists of a rectangular strip 24 that is intended to span or partially span the diameter of the exhaust duct collar 14. According to one embodiment, two thermal masses or blocks 32, 34 sandwiching the bimetal strip 24 by co-planar abutment of the masses with the bimetal strip.

Preferably, the co-planar abutment corresponds to the width of the bimetal strip 24. By being at least the width of the strip, the heat transfer between the masses 32, 34 and the strip is maximized so that the temperature of the portion of the strip that is in abutment with the masses tends to approach the temperature of the masses. By selection of an appropriate shape of the masses that is no wider than the width of the strip, obstruction of the flow of gases passing the bimetal strip in the duct is avoided as the masses 32, 34 lie within the gas flow footprint of the strip 24. The co-planar abutment extends along at least 50% of the length of the strip in order to enhance the heat transfer between the masses and the strip. A portion of the strip 24 remains unimpeded by the masses 32, 34 to allow the strip to bend under the influence of temperature.

Figure 7:
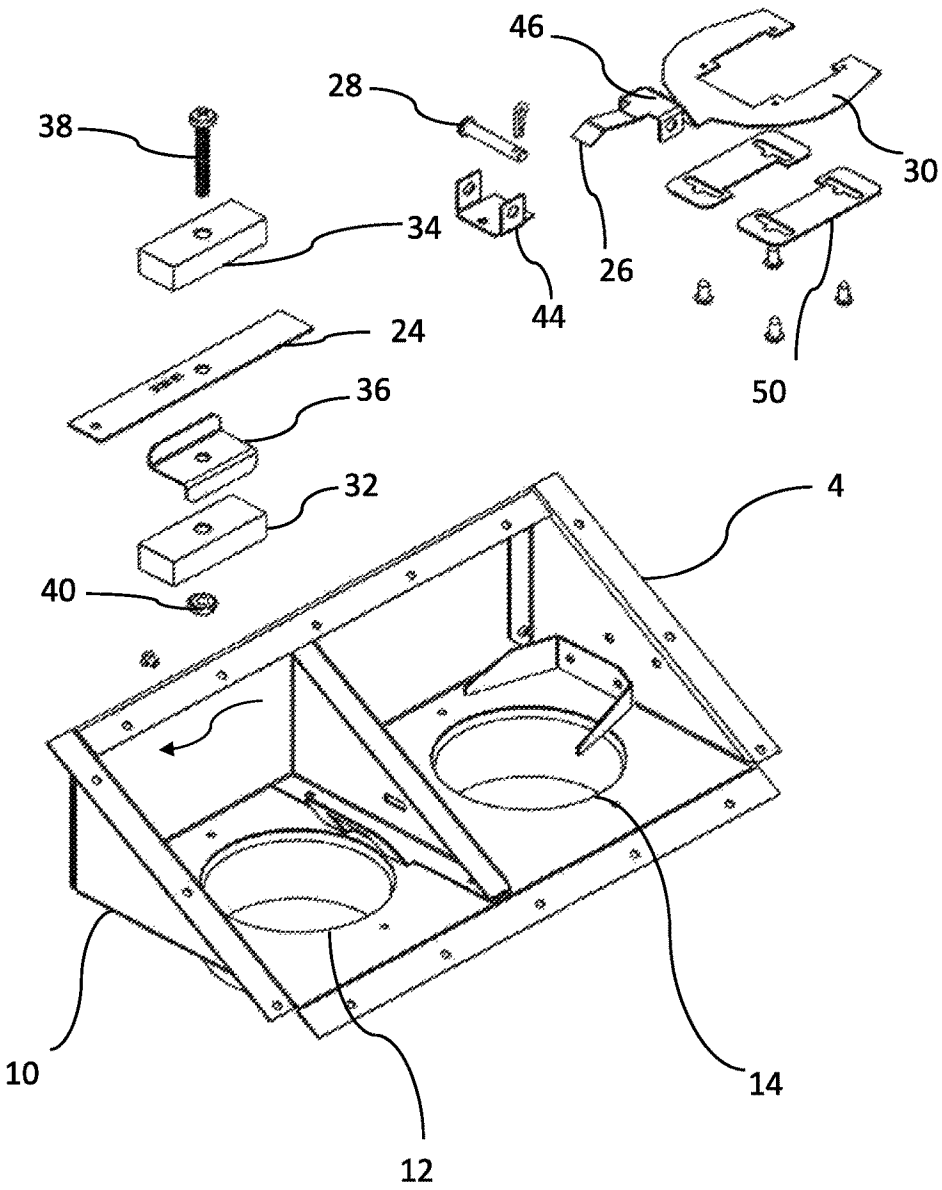
FIG. 7 is an exploded, inverted, perspective view of the duct interface assembly and its various components in the preferred embodiment.

Referring to FIG. 7, an alignment bracket 36 is positioned to abut the bimetal strip 24 and the thermal masses 32, 34 are positioned on the bracket 36 on opposite sides of the strip 24. The assembly is secured with a bolt 38 and a lock nut 40.

For operational purposes, the masses 32, 34 and the bimetal strip 24 are treated as a combined thermal mass since by virtue of the relatively large proportion of the strip's surface that is in contact with the masses 32, 34, the temperature of the bimetal strip 24 is maintained at substantially the temperature of the masses 32, 34, at least in the areas of abutment and the areas close thereto.

The bimetal strip 24 is selected such that its deflection temperature (from a low temperature, undeformed state to a high temperature, deformed state) is well below the typical steady state temperature of the exhaust duct near the firebox during the ON cycle of a sealed, direct vent gas fireplace. A typical such steady state temperature is in the range of 260-315° C. and a suitable bimetal strip is a strip measuring 18 mm by 117 mm by 1 mm sold by Emsclad (one alloy comprises 36% nickel and the balance of iron; the other alloy is 20% nickel, 6% manganese and the balance of iron).

The thermal masses 32, 34 and strip 24 of the preferred embodiment are selected such that, starting from the steady state ON cycle temperature of the exhaust duct and when the fireplace is then turned off, the rate of heat dissipation of their combined thermal mass is slower than the cool down rate of the gases in the duct in which the bimetal strip 24 is located. The difference should be enough that the temperature of the combined thermal mass stays above the bimetal strip deflection temperature for at least 15 minutes, being close to the standard target time for OFF cycle heat efficiency measures. Assuming that the bimetal strip would normally cause the damper to open in about 10 minutes after the initiation of the OFF cycle, and starting with flue temperatures in the range of 500° F. to 600° F., the use of the masses should preferably introduce an additional delay of 5-6 minutes.

Heat loss from the thermal masses is principally the result of convection to the passing gases rising by convection through the duct in which the bimetal is situated. The rate of heat dissipation from the thermal masses is a function of the temperature gradient between the masses and the ambient gases. That gradient is not a simple one in that the gases cool down over time on the one hand, and the temperature of the masses themselves changes with their own heat dissipation. Another factor is the surface area of the thermal mass which affects the contact/convection effects, and the thickness of the mass. The rate of heat dissipation will also be a function of the thermal conductivity of the material comprising the thermal masses.

Referring to FIGS. 3 and 5B, the assembly comprising the bimetal strip 24 and the attached masses 32, 34 is secured within a duct interface assembly casing 10. As seen in FIG. 1, the duct interface assembly 4 is mounted on a wall of the fireplace.

Bimetal strip 24 is located across the exhaust duct collar 14. It will be appreciated that for the purposes of the present description and claims, the exhaust collar 14 is effectively part of the exhaust duct 8 and the inlet collar 12 is effectively part of the inlet duct 6.

Bimetal strip 24 is secured at one end 41 to the casing 10, with the opposite end 42 being unattached and free to bend. The bimetal and masses assembly is preferably positioned within the enclosure so as to present the bimetal in a horizontal position to simplify any gravity effects on the bending of the bimetal. The damper assembly 22 is attached to the casing 10 by means of a flange 44 and a pivot bolt 28. The pivot bolt 28 is engaged in flange 44 depending from the damper 30 to allow the damper 30 to pivot about the pivot bolt 28. Gravity and the relatively heavier damper compared to the tongue ensure that the damper is normally open when not being urged to close by the operation of the bimetal strip.

The damper 30 includes a tongue extension 26 located in the vicinity and below the free end 42 of the bimetal strip 24 such that downward displacement of the free end 42 brings it into contact with the tongue 26. The free end 42 extends through a containment tab 48 (see FIG. 6B) that is secured to the casing 10 and that acts to prevent overbending of the bimetal strip 24 and possible bending of the damper assembly 22.

By reference to FIG. 5B, a slide plate 50 is preferably provided on the face of the damper 30 as shown in order to enable adjustment of the amount of air allowed past the damper in the closed position.

Testing and Results

Figure 7A:
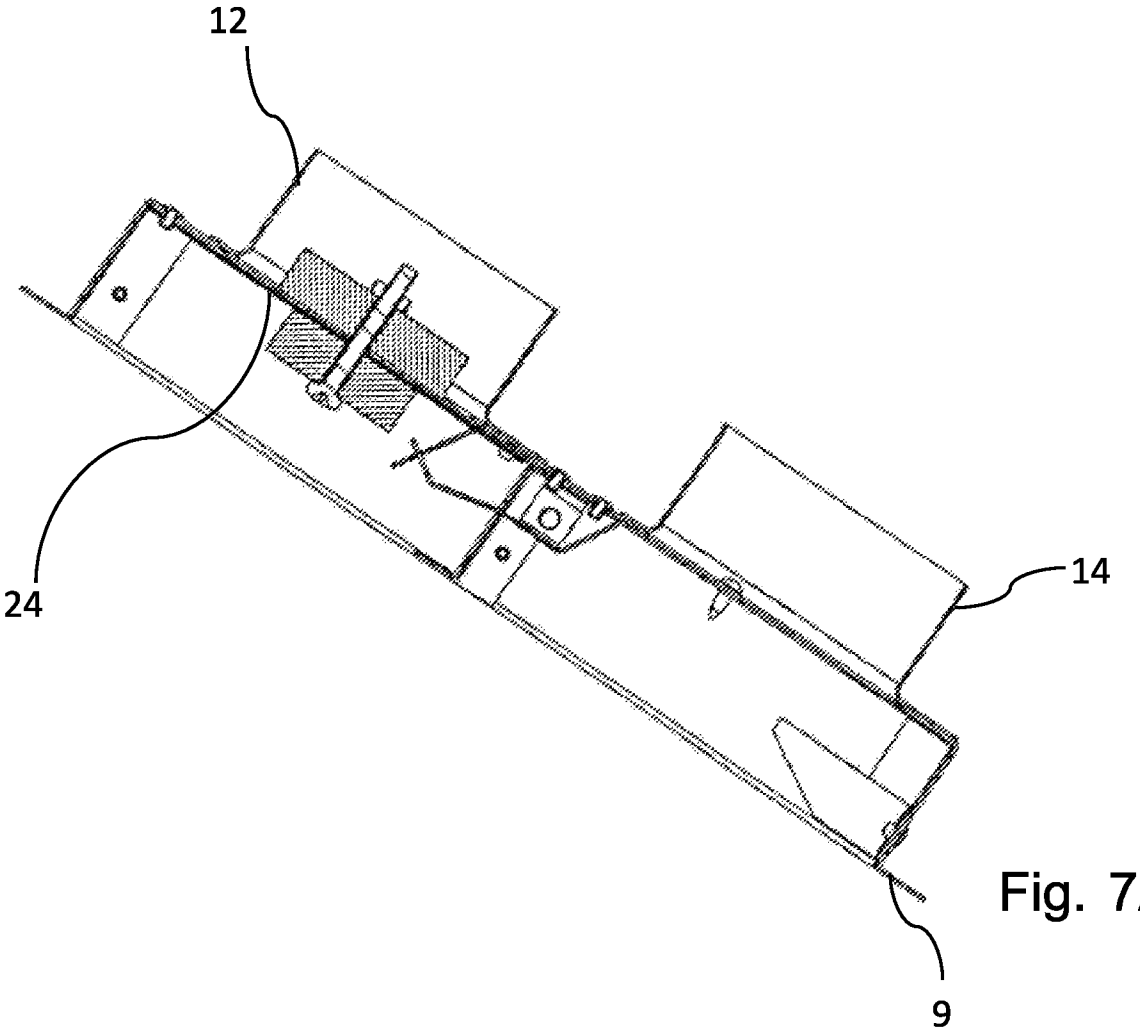
FIG. 7A is a side elevation of a test version of the interface assembly in which the bimetal strip was presented at an angle to the horizontal.
Figure 8:
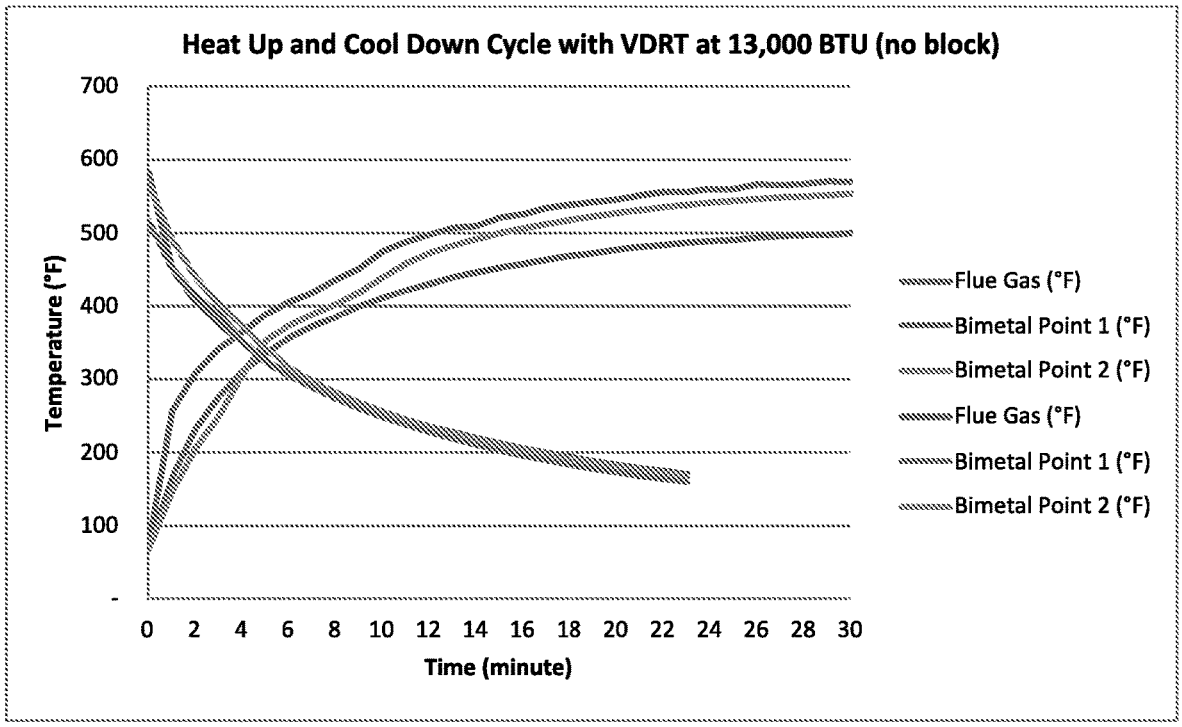
FIG. 8 is a graph of the temperatures recorded during a test using a 13,000 BTU fireplace with no thermal blocks.
Figure 9:
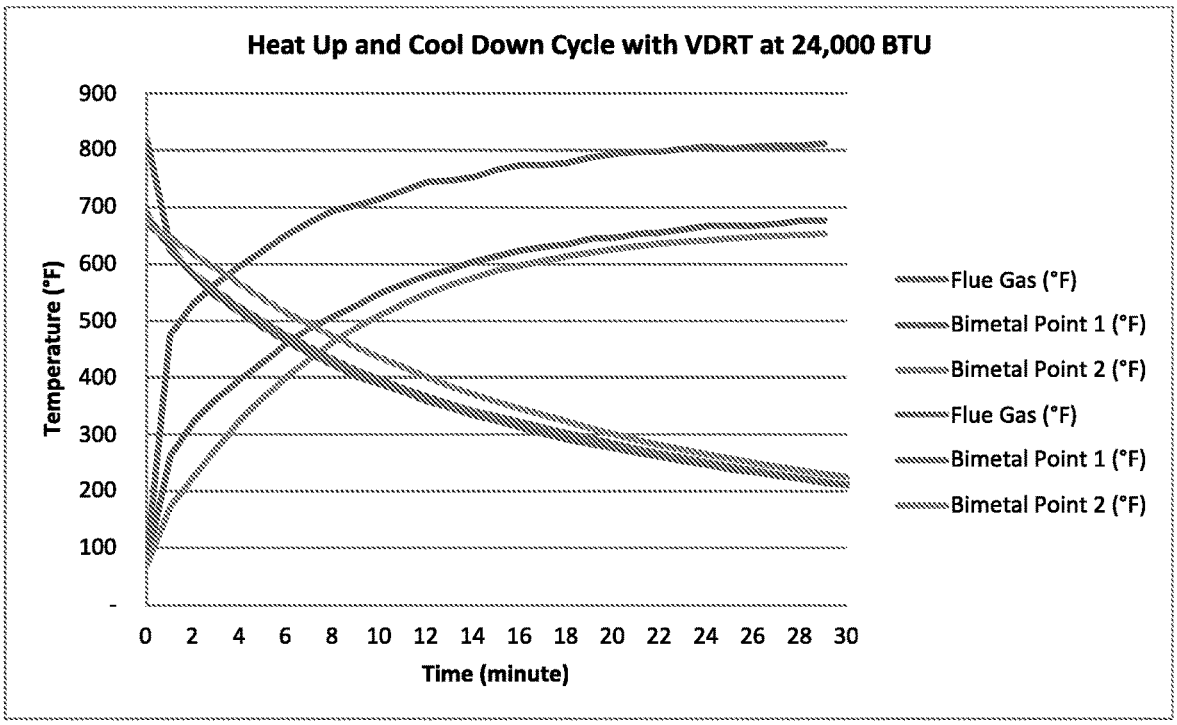
FIG. 9 is a graph of the temperatures recorded during a test using a 24,000 BTU fireplace with thermal blocks according to the preferred embodiment; and, FIG. 10 is a graph of the temperatures recorded during a test using 13,000 BTU fireplace with thermal blocks according to the preferred embodiment.
Figure 10:
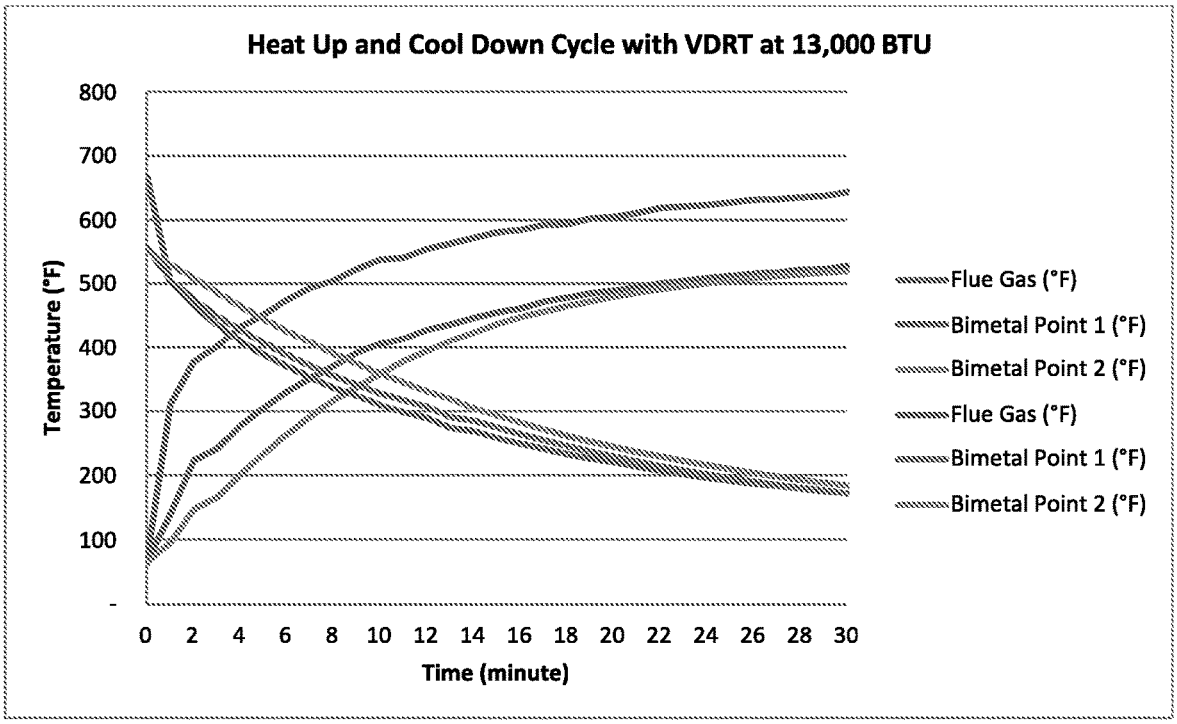

A test set-up included the structural components of the preferred embodiment but wherein the interface assembly presented the bimetal strip at an angle to the horizontal, as shown in FIG. 7A. A timing test to determine the opening and closing times for the damper were conducted with the preferred embodiment in which the bimetal strip is horizontal.

The exhaust duct and the intake duct were each 3 inches in diameter. The bimetal strip extended across the center of the exhaust cut with the flat horizontal Least Expanding Side (LES) of the bimetal facing down or upstream of the flue gases. One end of the strip was riveted to the enclosure body.

The system was installed with vertical ducting of over 10 feet. Flue gas temperatures were recorded by a thermocouple inserted at about the center of the exhaust duct.

Two temperature points were recorded on the bimetal. Bimetal point 1 was measured near the same end of the bimetal strip that was riveted to the enclosure. The second temperature measurement point for the bimetal strip was bimetal point 2 at the longitudinal center of the strip.

The testing involved operating the unit from a cold startup, leaving it on for an hour to allow the unit to reach a steady state ON condition then shutting off the fireplace to initiate the OFF cycle. The temperature of the flue gases and the bimetal temperatures were recorded at 30 second intervals.

In a first test, the thermal masses were omitted and the bimetal strip was exposed to the flue gases. The damper fully closed within 2.2 minutes of start up in the case of a 24,000 BTU unit and within 7 minutes for a 13,000 BTU unit. The damper began to open about 10 minutes after shut off of the fireplace for the 24,000 BTU unit and about 6 minutes after shut off for the 13,000 BTU unit. The transition temperature of the bimetal between bent and unbent states was in the range of 200° F.-250° F.

The set up was operated under "low fire" conditions with the fireplace producing 13,000 BTU/hr and the unit was cycled from ignition to steady state ON, through the OFF cycle. The data is summarized in Table 1.

TABLE 1

| 13,000 BTU/hr (no thermal masses) | | | | | |
|---|---|---|---|---|---|
| | Time (minute) | Description | Flue Gas | Bimetal Point 1 | Bimetal Point 2 |
| Heat Up | 0 to 5 | Average Temperature (° F.) | 323.99 | 250.13 | 238.2 |
| | | Average Temperature gained (° F./s) | 1.06 | 0.89 | 0.95 |
| | 5 to 10 | Average Temperature (° F.) | 432.09 | 380.14 | 399.26 |
| | | Average Temperature gained (° F./s) | 0.29 | 0.25 | 0.29 |
| | 10 to 15 | Average Temperature (° F.) | 502.04 | 435 | 477.25 |
| | | Average Temperature gained (° F./s) | 0.15 | 0.14 | 0.20 |
| | Steady State Temperature | | 584.42 | 515.68 | 567.10 |
| Cool Down | 0 to 5 | Average Temperature (° F.) | 395.22 | 389.67 | 419.62 |
| | | Average Temperature gained (° F./s) | −0.87 | −0.64 | −0.76 |
| | 5 to 10 | Average Temperature (° F.) | 281.87 | 278.2 | 287.3 |
| | | Average Temperature gained (° F./s) | −0.23 | −0.26 | −0.28 |
| | 10 to 15 | Average Temperature (° F.) | 230.29 | 220.99 | 228.82 |
| | | Average Temperature gained (° F./s) | −0.14 | −0.15 | −0.15 |
| | 16 | Temperature recorded | 205.66 | 195.06 | 203.77 |

The steady state ON cycle temperature of the flue gases for the low fire system was measured at about 584° F. At the steady state, the center point of the bimetal was at 567° F. During the first 10 minutes of the OFF cycle, the average temperature of the bimetal was within 6% of the flue gases temperature, and within about 2% of it from 5 to 10 minutes after shut off of the unit. The bimetal temperature therefore tracks the flue temperature. The damper fully opened 10 minutes after shut off.

The embodiment of FIG. 7A was also tested using two separate masses of steel having a carbon content of less than 1% with a total mass of 163 g, sandwiching the aforementioned bimetal as shown in FIG. 4. The dimensions of the two masses were 2.00" in length by 0.75" in width by 0.5" in height.

The set up was operated at the same low fire setting of 13,000 BTU/hr. Table 2 is a summary of the data collected.

In the 5 to 15 minute period following shut off, the temperature of the bimetal's center point that was sandwiched between the two masses remained at a 35-38% higher temperature than the flue gases in the duct. That represents significant heat retention over the relevant period of time when the bimetal alone would have triggered the opening of the damper. For damper timing closing and opening tests, masses of 186 g were used. In this set up, the damper began to open 13.3 minutes after shut off and was fully open 22 minutes after shut off, compared to 6 and 10 minutes when no thermal masses were attached to the bimetal strip. That represents a delay of 7-12 minutes for the bimetal to reach the transition temperature required for it to significantly deflect and actuate the damper.

The same set up of the embodiment of FIG. 7A was operated at a "high fire" rate of 24,000 BTU/hr. Table 3 is a summary of the data collected.

TABLE 2

| 13,000 BTU/hr (thermal masses as in FIG. 4) | | | | | |
|---|---|---|---|---|---|
| | Time (minute) | Description | Flue Gas | Bimetal Point 1 | Bimetal Point 2 |
| Heat Up | 0 to 5 | Average Temperature (° F.) | 317.95 | 222.2 | 152.01 |
| | | Average Temperature gained (° F./s) | 1.07 | 0.81 | 0.56 |
| | 5 to 10 | Average Temperature (° F.) | 425.55 | 361.31 | 306.55 |
| | | Average Temperature gained (° F./s) | 0.22 | 0.31 | 0.43 |
| | 10 to 15 | Average Temperature (° F.) | 491.42 | 422.9 | 708.3 |
| | | Average Temperature gained (° F./s) | 0.19 | 0.15 | 0.28 |
| | Steady State Temperature | | 587.16 | 530.91 | 580.59 |
| Cool Down | 0 to 5 | Average Temperature (° F.) | 453.03 | 449.32 | 541.33 |
| | | Average Temperature gained (° F./s) | −0.72 | −0.5 | −0.3 |
| | 5 to 10 | Average Temperature (° F.) | 323.22 | 333.82 | 436.5 |
| | | Average Temperature gained (° F./s) | −0.31 | −0.28 | −0.33 |
| | 10 to 15 | Average Temperature (° F.) | 246.83 | 261.24 | 340.8 |
| | | Average Temperature gained (° F./s) | −0.18 | −0.21 | −0.30 |
| | 16 | Temperature recorded | 217.99 | 225.91 | 289.20 |

TABLE 3

| 24,000 BTU/hr (thermal masses as in FIG. 4) | | | | | |
|---|---|---|---|---|---|
| | Time (minute) | Description | Flue Gas | Bimetal Point 1 | Bimetal Point 2 |
| Heat Up | 0 to 5 | Average Temperature (° F.) | 506.01 | 379.82 | 255.73 |
| | | Average Temperature gained (° F./s) | 1.70 | 1.36 | 1.06 |
| | 5 to 10 | Average Temperature (° F.) | 660.86 | 555.43 | 509.75 |
| | | Average Temperature gained (° F./s) | 0.34 | 0.40 | 0.66 |
| | 10 to 15 | Average Temperature (° F.) | 735.72 | 649.33 | 654.56 |
| | | Average Temperature gained (° F./s) | 0.20 | 0.24 | 0.36 |
| | Steady State Temperature | | 798.30 | 729.43 | 783.75 |
| Cool Down | 0 to 5 | Average Temperature (° F.) | 539.35 | 557.20 | 687.37 |
| | | Average Temperature gained (° F./s) | −1.12 | −0.84 | −0.58 |
| | 5 to 10 | Average Temperature (° F.) | 402.57 | 412.34 | 535.86 |
| | | Average Temperature gained (° F./s) | −0.33 | −0.36 | −0.43 |
| | 10 to 15 | Average Temperature (° F.) | 319.02 | 327.07 | 427.41 |
| | | Average Temperature gained (° F./s) | −0.26 | −0.24 | −0.33 |
| | 16 | Temperature recorded | 273.15 | 283.33 | 363.69 |

The temperature of the bimetal's center point remained at a 34% higher temperature than the flue gases in the duct. In timing tests, the damper started to open 16 minutes after shut off and was fully open 28 minutes after shut off. That represents a delay of 6-11 minutes for the bimetal to reach the transition temperature required for it to significantly deflect and actuate the damper.

The invention achieves a number of advantages. The damper remains closed thereby retaining the heat in the appliance, and preventing it from dissipating rapidly into the ducts, for a time that substantially satisfies the 16 minute OFF cycle efficiency standard targets, and in any event considerably longer than is the case without the mass-attenuated thermosensitive damper system of the present invention. By placing the damper in the inlet, while retaining the bimetal actuator in the exhaust, both the cold start reliability and the OFF cycle efficiency are achieved, while also enabling adequate combustion even in overfire conditions.

The thermal mass or masses attenuate the effects of both the heating up and the cooling down of the bimetal under the influence of the heating up or cooling down of the flue gases. Apart from delaying the opening of the damper during the OFF cycle and thereby increasing OFF cycle efficiency, the attenuation of the bimetal response also extends the period during which the damper remains open after ignition, which ensures sufficient air flow to maintain ignition and avoid inadvertent loss of combustion as the firebox warms up. The inclusion of the bottom mass on the underside of the bimetal strip, to complete the sandwiching of the strip, also served to reduce the surface area of the strip that is exposed to the warming flue gases after ignition, thereby contributing to the delay in the closing of the damper during the ON cycle.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

What is claimed is:

1. A damper actuation system for use in actuating a normally open damper in a sealed, direct-vent gas fireplace to cause said damper to selectively obstruct airflow in a duct of said fireplace, comprising:

a bimetal strip for actuating said damper;

said bimetal strip being attached to a housing for said damper at an attachment point; and, at least one heat absorbing block secured to said bimetal strip at a location that is spaced from said attachment point and in co-planar abutment with said bimetal strip for attenuating changes in temperature of said bimetal strip under the influence of gases in said duct, said heat absorbing block having a mass that is at least 5 times the mass of said bimetal strip.

2. The damper actuation system of claim 1, wherein said at least one heat absorbing block delays by at least 5 minutes the opening of said damper, during an OFF cycle of said fireplace initiated when the temperature of gases in an exhaust duct of said fireplace is over 480° F., as compared to the time taken to open said damper using said bimetal strip without the bimetal strip receiving heat dissipation from said at least one heat absorbing block.

3. The damper actuation system of claim 1 wherein said at least one heat absorbing block comprises at least one rectangular block that is attached to said bimetal strip so that said co-planar abutment spans the width of said bimetal strip along at least 50% of a length of said bimetal strip.

4. The damper actuation system of claim 3 wherein said at least one heat absorbing block has a width no greater than the width of said bimetal strip.

5. A fireplace having an exhaust duct and further including the damper actuation system of claim 1 wherein said bimetal strip and said at least one heat absorbing block are located in said exhaust duct of said fireplace.

6. A damper actuation system for use in actuating a normally open damper in a sealed, direct-vent gas fireplace, comprising a bimetal strip for actuating said damper and at least one heat absorbing block secured in co-planar abutment with said bimetal strip for attenuating changes in temperature of said bimetal strip under the influence of gases in said duct, said at least one heat absorbing block having a mass that is at least 5 times the mass of said bimetal strip wherein said bimetal strip and said at least one heat absorbing block are located in an exhaust duct of said fireplace and said damper is located in an inlet duct of said fireplace.

7. The damper actuation system of claim 5 wherein said bimetal strip and said at least one heat absorbing block maintain average temperatures over 5 minute intervals at a longitudinal center of said bimetal strip, during an OFF cycle of said fireplace initiated when the temperature of gases in said exhaust duct are at least 480° F., that are at least 25% higher than the average temperatures, over the same 5 minute intervals, of said gases during said OFF cycle as compared to the damper actuation system having no heat absorbing block abutting and dissipating heat into said bimetal strip.

* * * * *